US005732424A

United States Patent [19]

Bond

[11] Patent Number: 5,732,424

[45] Date of Patent: Mar. 31, 1998

[54] BEDDING ARRANGEMENT

[76] Inventor: L. Ruth Bond, 42 Sunnyvale Crescent, Lower Sackville, Nova Scotia, Canada, B4E 2G6

[21] Appl. No.: 698,334

[22] Filed: Aug. 15, 1996

[51] Int. Cl.[6] ..... A47G 9/00; A47G 9/04

[52] U.S. Cl. ..... 5/502; 5/498

[58] Field of Search ..... 5/502, 496, 498, 5/923, 493

[56] References Cited

U.S. PATENT DOCUMENTS

| | | | |
|---|---|---|---|
| 2,789,292 | 4/1957 | Budinquest | 5/496 |
| 2,799,870 | 7/1957 | Sullivan . | |
| 3,083,378 | 4/1963 | Pursell | 5/498 |
| 3,832,743 | 9/1974 | Smith . | |
| 3,857,124 | 12/1974 | Hadley | 5/496 |
| 3,965,504 | 6/1976 | Ainsworth . | |
| 4,241,466 | 12/1980 | Mendyk . | |
| 4,316,299 | 2/1982 | Friedman | 5/502 |
| 4,339,835 | 7/1982 | Jaffe et al. | 5/498 |
| 4,413,368 | 11/1983 | Schuetze | 5/502 |
| 4,488,323 | 12/1984 | Colburn | 5/496 |
| 4,513,461 | 4/1985 | Tardivel | 5/502 |
| 5,042,099 | 8/1991 | Brenner et al. | 5/502 |
| 5,092,010 | 3/1992 | Wong | 5/502 |
| 5,566,411 | 10/1996 | Eiler | 5/502 |

FOREIGN PATENT DOCUMENTS 910516 9/1972 Canada .

*Primary Examiner*—Alexander Grosz
*Attorney, Agent, or Firm*—Jones, Tullar & Cooper, P.C.

[57] ABSTRACT

A bedding arrangement specifically designed for children's bunk beds, but useful in other situations where a bed is only accessible from one side, and where there is difficulty in tucking sheets under a mattress. The bedding arrangement comprises, basically, a rectangular mattress cover which can be secured to a mattress, and a rectangular insulating covering such as a blanket or bed cover attached, preferably sewn, along a rear one of its longer edges to a rear edge of the mattress cover. The arrangement also includes a sheet or liner foldable to produce two rectangular panels permanently connected along adjacent rear edges, the panels being similar in size to the mattress cover. Releasable fasteners are provided on the inwardly facing surfaces of the mattress cover and covering and which cooperate with releasable fasteners adjacent the margins of the outer surfaces of the sheet or liner panels.

6 Claims, 2 Drawing Sheets

BEDDING ARRANGEMENT

FIELD OF THE INVENTION

The present invention relates to a bedding arrangement particularly for beds such as children's bunk beds which are only accessible from one side. The invention provides an arrangement in which certain of the bed clothes remain attached to each other, minimizing disturbance of the bed clothes during sleeping, and in which a bed can easily be made from one side.

PRIOR ART

The prior art contains various examples of bedding and/or sleeping bag arrangements intended to keep bed clothes in place and to allow beds to be made up more easily than with the conventional arrangement. For example, many prior art arrangements avoid the need for sheets or coverings to be tucked under the mattress. Examples of prior art arrangements are as follows:

U.S. Pat. No. 2,799,870, issued Jul. 23, 1957 to Sullivan
U.S. Pat. No. 3,832,743, issued Sep. 3, 1974 to Smith
U.S. Pat. No. 3,965,504, issued Jun. 29, 1976 to Ainsworth
U.S. Pat. No. 4,241,466, issued Dec. 30, 1980 to Mendyk
U.S. Pat. No. 4,339,835, issued Jul. 20, 1982 to Jaffe et al.
U.S. Pat. No. 4,513,461, issued Apr. 30, 1985 to Tardivel
U.S. Pat. No. 4,488,323, issued Dec. 18, 1984 to Colburn
U.S. Pat. No. 5,042,099, issued Aug. 27, 1991 to Brenner et al.
U.S. Pat. No. 5,092,010, issued Mar. 3, 1992 to Wong; and
Canadian Patent No. 910,516, issued Sep. 19, 1972 to Springs.

SUMMARY OF THE INVENTION

The present invention is specifically designed for children's bunk beds, but may be useful in other situations where a bed is only accessible from one side. Bunk beds are usually placed against a wall, on at least two sides, and are usually too heavy to move when the bed is being made. This makes it difficult to put in place the bottom fitted sheet, given also the lack of space when working on the lower bunk, and the height when working on the upper bunk. Once the bottom sheet is fitted a similar difficult procedure must be followed for the top sheet. The procedure of making a bunk bed is practically impossible for a child to perform. Furthermore, the whole procedure has to be done the next morning since blankets and sheets become untucked during the night.

The bedding arrangement of this invention holds the bedding items in place without unduly restricting a child's movement, and also allows the bed to be made up with a few simple movements. There is no requirement for having access to the rear side of the bed. With this arrangement, children can be taught to make their own bunk beds.

In accordance with the present invention, a bedding arrangement comprises:

- a rectangular mattress cover including means for releasably securing the cover to a mattress, and having front and rear edges and ends shorter than the sides;
- a rectangular insulating covering such as a blanket or bed cover attached along a rear one of its longer edges to the rear edge of the mattress cover;
- a sheet or liner foldable to produce two rectangular panels permanently connected along adjacent rear edges but otherwise not connected to each other, said panels being similar in size to the mattress cover; and
- releasable fastener means on inwardly facing surfaces of the mattress cover and covering, and capable of cooperating with fastener means positioned adjacent the margins of the outer surfaces of the sheet or liner panels.

With this arrangement, the bottom sheet or liner panel can be detachably secured to the mattress cover and the top sheet or liner panel can be detachably secured to the insulated covering.

The insulated covering is preferably sewn to the rear edge of the mattress cover, and this covering and the mattress cover are not otherwise permanently connected together.

With this arrangement there is no need to fit a bottom sheet onto a mattress. The mattress cover is fitted onto the mattress, but this can remain in place for several weeks or months. When it is desired to change the liner or sheet panels, these are easily detached from the releasable fastener means of the mattress cover and covering, an operation which does not require access to the rear side of the bed. Making up the bed is extremely simple, comprising in effect merely straightening out the top covering with its attached sheet or liner panel, and smoothing the bottom sheet or liner panel.

In a preferred form of the arrangement, the insulated covering has a front portion dimensioned to extend beyond a front edge of the mattress cover, and has releasable fastener means adapted to cooperate with fastener means on the front of the mattress cover.

BRIEF DESCRIPTION OF THE DRAWINGS

The invention will be further described with reference to the accompanying drawings, in which.

DETAILED DESCRIPTION

Figure 1:
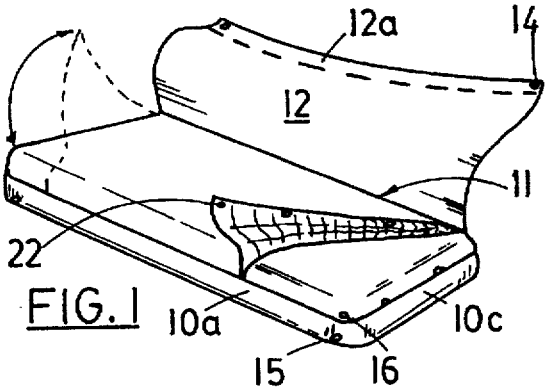
FIG. 1 is a perspective view of the bedding arrangement in which the insulated covering has been raised and the upper sheet or line panel has been partially raised.
Figure 3:
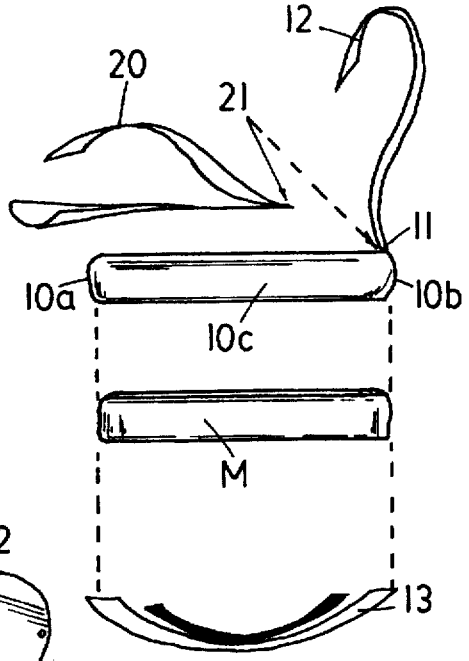
FIG. 3 is a view of the same components as FIG. 2, but with the sheet or liner partially removed.
Figure 2:
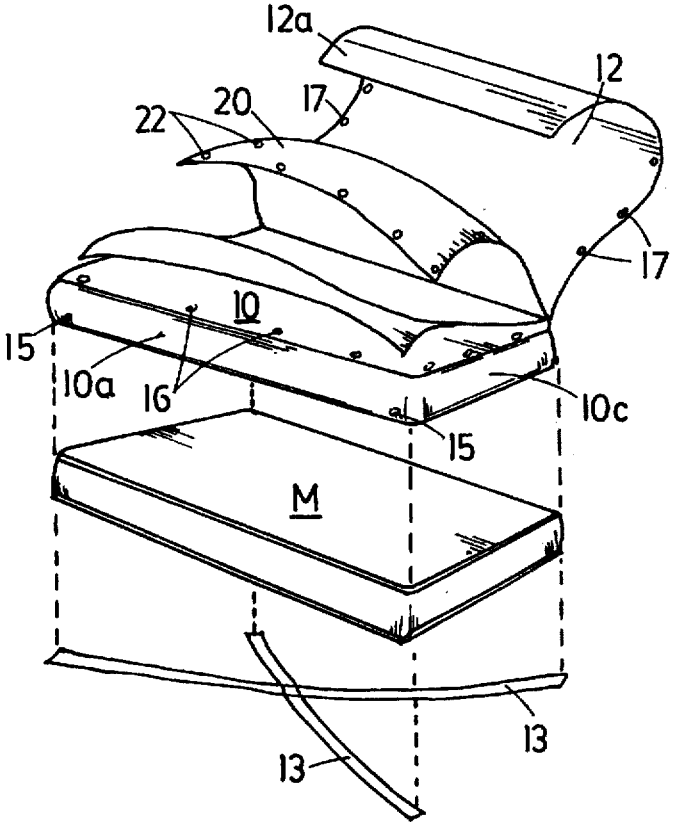
FIG. 2 is a perspective, exploded view of the bedding arrangement along with a standard mattress.

The bedding arrangement is shown in FIGS. 1 to 3 as applied to a rectangular mattress M which is conventional and not a part of this invention.

The main component of this invention is the combination of mattress cover 10 and insulating covering 12, the latter being permanently attached to the mattress cover by a seam 11 along the rear edge of the cover.

The cover itself is of conventional fitted form, having a main central panel and front and rear sides 10*a* and 10*b* respectively, and ends 10*c*, the whole cover being of rectangular shape to suit the mattress. The preferred material is a polyester/cotton blend. Two straps 13 are provided extending between opposite corners of the side portions of the cover, and having snap fasteners for attachment to the cover so that they can be fitted under the mattress M and hold the cover in place. These are made to ensure a snug fit onto the mattress.

Figure 4:
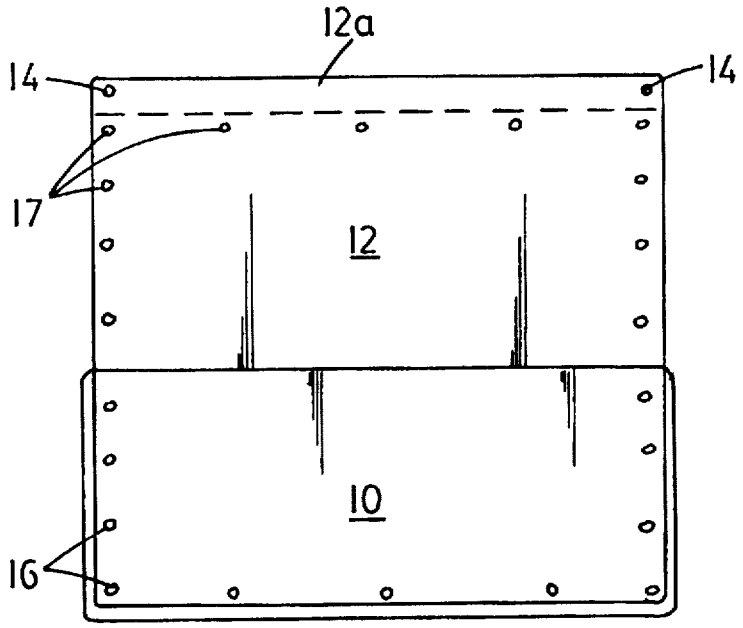
FIG. 4 is a plan view of the combination of mattress cover and insulating covering, when unfolded.

The insulating covering 12 may be in the form of a blanket or coverlette, comforter, quilt, etc. In the preferred form, as best shown in FIG. 4, this is wider than the mattress cover so as to provide a front portion 12*a* capable of draping down over a front edge of the mattress cover. Snap fasteners 14 and 15 are placed respectively at the ends of this portion and at the lower corners of the front of the mattress cover so that the covering can be secured when desired.

The upper surface of the mattress cover and the lower surface of the covering are both provided with detachable fasteners, such as snap fasteners 16 and 17, for holding in place the sheet/liner member to be described. For the mattress cover 10, these fasteners 16 are spaced along a front outer edge of the main part of the cover, and along its end edges; for the covering 12 the fasteners 17 are spaced along the end edges and are also spaced along the front inside of the covering just inside the front portion 12*a*.

The other component of the bedding arrangement is a sheet/liner member 20, which may be of typical bed sheet type material (for example linen or cotton) or may be of heavier material such as flannelette. This is a simple, easily laundered, rectangular piece of material, which when folded along a central fold 21 can fit exactly on the top part of the mattress cover, underneath the covering 12. One surface of this member 20, which is the outer surface when folded, has fastening means 22 provided around its edges in locations suitable for fitting onto the snap fasteners 16 and 17 of the mattress cover and insulated covering. This liner member is placed as indicated in FIG. 3, with its rear fold situated along the seam between the mattress cover and the covering 12. A newly laundered member 20 is put in position as indicated in FIG. 3 and then secured by the fasteners 16, 17 and 22.

In use, the covering 12 of course remains attached to the rear end of the mattress cover, and the upper and lower sheet panels of member 20 remain attached to the mattress cover and covering respectively, so that little disarrangement of the bed occurs in normal use. In the morning, the bed can be "made" very simply by straightening the sheet/liner member, if necessary pushing the crease 21 back into place, and straightening the covering 12 with its attached sheet/liner panel. Essentially, only a smoothing operation is required, such as child can be trained to do, and there is no need for any lifting or tucking under the mattress. When it is required to launder the sheet or liner member 20, this is removed from the fastening 16 and 17, and replaced with a fresh liner, again without any lifting of the mattress or tucking being required.

Figure 5:
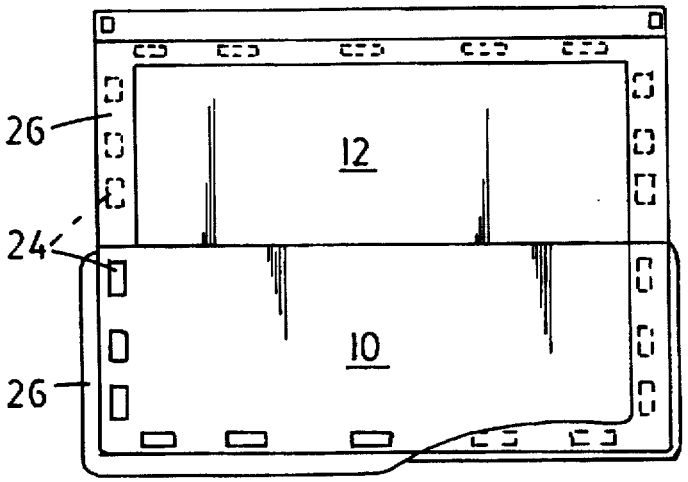
FIG. 5 is a view similar to FIG. 4 of a modified arrangement.

FIG. 5 shows an alternative embodiment of the invention, having two features different from what is apparent from FIG. 4. Firstly, in place of the snap fasteners 16 and 17, loop and pile fasteners 24 of the "Velcro"™ type are used, with corresponding fasteners on the outside surfaces of the sheet panel. Secondly, a tape 26 of bedding sheet type material is sewn around the outer edge of the mattress cover and around a corresponding area of the covering, being foldable so as to cover the fastening means 24. With this arrangement, when a fresh sheet panel is to be fitted in place, the tape strip 26 is unfolded as indicated at the lower part of FIG. 5, the sheet is attached and tape 26 is then folded into place. The tape helps to protect the edges of the sheet from being dislocated.

I claim:

1. A bedding arrangement comprising:

a rectangular mattress cover including means for releasably securing the cover to a mattress, said cover having front and rear sides and edges and ends which are shorter than the sides;

a rectangular insulating covering such as a blanket or bed cover having front, rear and end edges and attached along the rear edge thereof to the rear edge of the mattress cover, said covering having a front portion dimensioned to extend beyond the front edge of said mattress cover;

a sheet or liner foldable to produce top and bottom rectangular panels permanently connected along rear edges thereof but otherwise unconnected, said panels being similar in size to the mattress cover; and releasable fastener means on inwardly facing surfaces of the mattress cover and the insulating covering respectively, positioned adjacent the front and end edges thereof and capable of cooperating with fastener means positioned adjacent front and end edges of the outer surfaces of the said sheet or liner panels;

whereby the bottom sheet or liner panel can be detachably secured to the mattress cover and the top sheet or liner panel can be detachably secured to the insulated covering.

2. A bedding arrangement according to claim 1, wherein the insulating covering is sewn to the rear edge of the mattress cover, the insulating covering and mattress cover being not otherwise permanently connected together.

3. A bedding arrangement according to claim 2, wherein said front portion has releasable fastener means adapted to cooperate with fastener means on the front side of the mattress cover.

4. A bedding arrangement according to claim 2, wherein strips of tape are attached to the front and end edges of the cover and adjacent the front and end edges of the covering and are suitable for overlying the positions of the fastener means.

5. A bedding arrangement according to claim 1, wherein said front portion has releasable fastener means adapted to cooperate with fastener means on the front side of the mattress cover.

6. A bedding arrangement according to claim 1, wherein strips of tape are attached to the front and end edges of the cover and adjacent the front and end edges of the covering and are suitable for overlying the positions of the fastener means.

* * * * *